US006932455B2

(12) United States Patent
Monclus et al.

(10) Patent No.: US 6,932,455 B2
(45) Date of Patent: Aug. 23, 2005

(54) PRINTING APPARATUS AND METHOD

(75) Inventors: Antonio Monclus, Barcelona (ES); Martin Urrutia, Barcelona (ES); Juan Manuel Valero, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/426,574

(22) Filed: Apr. 30, 2003

(65) Prior Publication Data

US 2004/0218003 A1 Nov. 4, 2004

(51) Int. Cl.[7] ..... B41J 2/165
(52) U.S. Cl. ..... 347/22; 347/33; 347/36
(58) Field of Search ..... 347/33, 22, 36, 347/29, 31, 35

(56) References Cited

U.S. PATENT DOCUMENTS

| | | | | |
|---|---|---|---|---|
| 4,369,456 | A | | 1/1983 | Cruz-Uribe et al. |
| 4,853,717 | A | | 8/1989 | Harmon et al. |
| 4,933,015 | A | | 6/1990 | White |
| 4,947,190 | A | | 8/1990 | Mizusawa et al. |
| 5,040,000 | A | | 8/1991 | Yokoi |
| 5,103,244 | A | | 4/1992 | Gast et al. |
| 5,115,250 | A | | 5/1992 | Harmon et al. |
| 5,146,243 | A | | 9/1992 | English et al. |
| 5,155,497 | A | | 10/1992 | Martin et al. |
| 5,250,962 | A | | 10/1993 | Fisher et al. |
| 5,300,958 | A | | 4/1994 | Burke et al. |
| 5,589,865 | A | | 12/1996 | Beeson |
| 5,719,602 | A | | 2/1998 | Hackleman et al. |
| 5,734,394 | A | | 3/1998 | Hackleman |
| 5,742,305 | A | | 4/1998 | Hackleman |
| 5,745,133 | A | | 4/1998 | Hendricks et al. |
| 5,943,067 | A | | 8/1999 | Kong |
| 6,102,518 | A | | 8/2000 | Taylor |
| 6,113,216 | A | | 9/2000 | Wong |
| 6,123,410 | A | | 9/2000 | Beerling et al. |
| 6,135,585 | A | | 10/2000 | Johnson et al. |
| 6,155,667 | A | | 12/2000 | Eckard et al. |
| 6,179,419 | B1 | | 1/2001 | Rasmussen et al. |
| 6,193,357 | B1 | | 2/2001 | Medin |
| 6,224,186 | B1 | | 5/2001 | Johnson et al. |
| 6,250,736 | B1 | * | 6/2001 | Wojcik ..... 347/33 |
| 6,250,738 | B1 | | 6/2001 | Waller et al. |
| 6,318,920 | B1 | * | 11/2001 | Silverbrook ..... 400/653 |
| 6,328,411 | B1 | | 12/2001 | Taylor et al. |
| 6,341,845 | B1 | | 1/2002 | Scheffelin et al. |
| 6,361,141 | B1 | * | 3/2002 | Baitz ..... 347/32 |
| 6,389,241 | B1 | | 5/2002 | Cernusak et al. |
| 6,402,290 | B1 | | 6/2002 | Johnson et al. |
| 6,409,304 | B1 | | 6/2002 | Taylor |
| 6,464,327 | B1 | | 10/2002 | Eckard et al. |
| 6,467,874 | B1 | | 10/2002 | Williams et al. |
| 6,663,215 | B2 | * | 12/2003 | Klausbruckner et al. ..... 347/22 |

FOREIGN PATENT DOCUMENTS

| | | | |
|---|---|---|---|
| DE | 3817754 | A1 | 11/1989 |
| EP | 0589604 | B1 | 3/1994 |
| GB | 2218049 | A | 11/1989 |
| GB | 2238510 | A | 6/1991 |
| JP | 59115863 | * | 4/1984 |

* cited by examiner

*Primary Examiner*—Stephen D. Meier
*Assistant Examiner*—Ly T Tran
(74) *Attorney, Agent, or Firm*—Foley & Lardner LLP

(57) ABSTRACT

A inkjet printing device comprising a drum platen, the platen having a recess in its circumferential surface. The recess is adapted to accept an inkjet servicing device. The inkjet servicing device, for example a spittoon, may be permanently or semi-permanently located in the recess. Alternatively, The inkjet servicing device, for example a printhead wiper element, may from time to time pass into or through the recess.

24 Claims, 4 Drawing Sheets

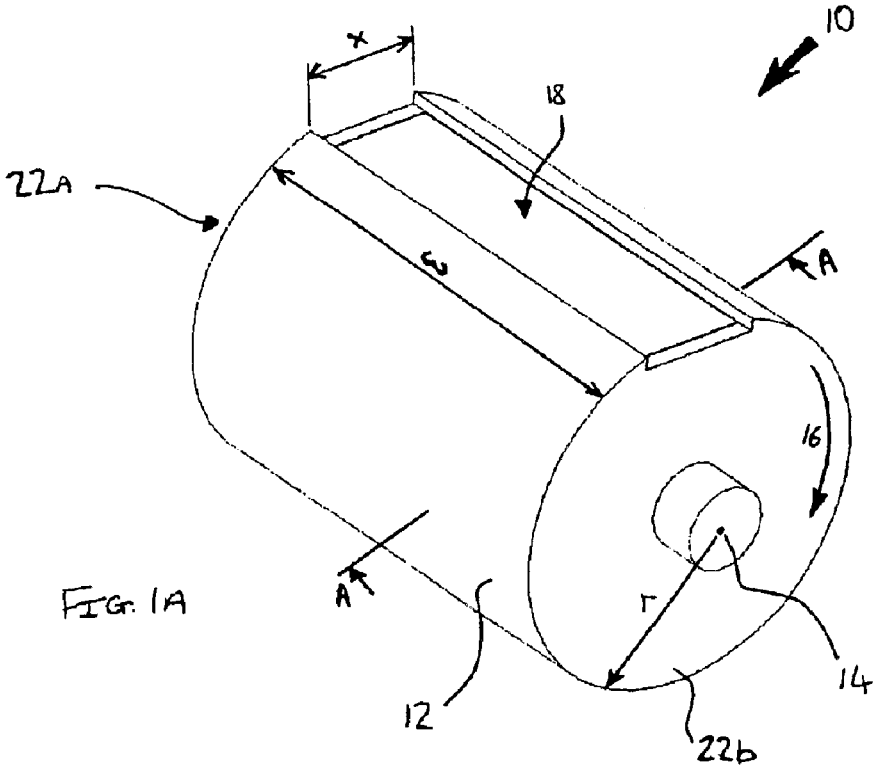
FIG. 1A
FIG 1B
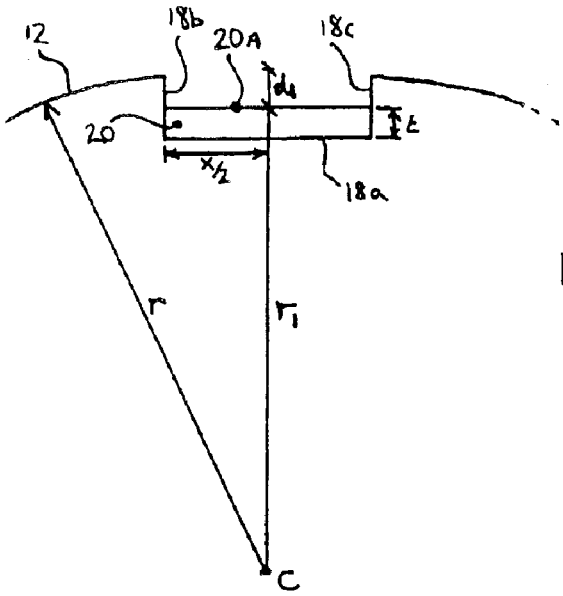
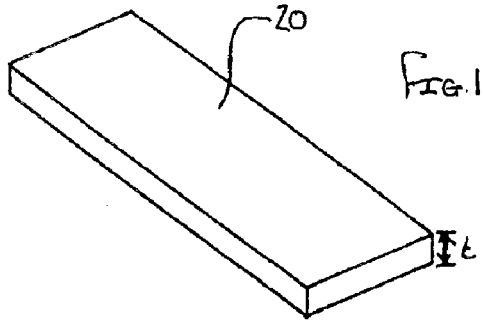
FIG. 1C

PRINTING APPARATUS AND METHOD

CROSS-REFERENCE TO RELATED PATENT APPLICATIONS

The present application is related to co-pending U.S. patent application Ser. No. 10/382,650 filed on Mar. 6, 2003 by Bruce G. Johnson, the full disclosure of which is hereby incorporated by reference.

FIELD OF THE INVENTION

The present invention relates generally to hardcopy devices and methods, particularly but not exclusively to inkjet printers and to methods of servicing inkjet printers.

BACKGROUND OF THE INVENTION

As is well known in the art, conventional inkjet printers generally employ one or more inkjet cartridges, often called "pens", which eject drops of ink onto a page or sheet of print media. For instance, two earlier thermal ink ejection mechanisms are shown in U.S. Pat. Nos. 5,278,584 and 4,683,481, both assigned to Hewlett-Packard Company. Historically, the pens are usually mounted on a carriage, which is arranged to scan across a scan axis relative to a sheet of print media as the pens print a series of individual drops of ink on the print media. The series of drops collectively form a band or "swath" of an image, such as a picture, chart or text. Between scans, the print medium is advanced relative to the scan axis. In this manner, an image may be incrementally printed.

Over recent years the importance placed on the throughput of inkjet printers has risen dramatically. Throughput is generally measured as the number of pages of a given size, or the area of print media that a printer may ink in a given time.

One approach to increasing the throughput of such printers is to use one or more static arrays of print nozzles which span the width of pages to be printed on. Pages of print media may then be loaded onto a belt or a drum and transported under one or more page wide arrays of print nozzles, or print bars. Although such page wide array systems offer the possibility of increased throughput, they suffer from certain disadvantages.

In order to ensure satisfactory print quality, inkjet printheads must be periodically serviced. Conventional servicing operations include, for example, "spitting" and "wiping" routines. Spitting is the term given to the process by which a number of ink drops are fired through one or more nozzles of a printhead into a waste ink collection reservoir termed a spittoon. This process may be used in order to remove a blockage in the nozzle caused by dried ink or other matter. Wiping is the process by which the printhead surface is cleaned with a wiping element to remove any ink residue, paper dust, or other matter that has collected on the face of the printhead. Commonly, wiping is implemented using one or more elastomeric wiping elements which are loaded with an ink solvent such as polyethylene glycol ("PEG") compound in order to facilitate the wiping process.

In scanning inkjet systems a "service station" mechanism is typically located within the printer chassis outside the media feed path. When a servicing routine is required, the inkjet printheads are moved to a position adjacent the service station so that the servicing may be carried out. However, the print bars of page wide printer systems are generally bulky. Thus, moving such print bars to a service station spaced apart from the media feed path tends to increase the working volume of the printer system and the complexity of servicing operations.

It would therefore be desirable to provide a printing device and method, which addresses the problems found in the prior art.

SUMMARY OF THE INVENTION

According to one aspect of the present invention, there is provided an inkjet printing device comprising a drum platen, the platen having a spittoon disposed in the surface of the drum. Advantageously, by locating a spittoon in the surface of the drum, the rotation of the drum relative to the inkjet nozzles of the printer may bring both the spittoon and the image receiving surface associated with the drum, for example a sheet of print media, into a position adjacent the inkjet nozzles in an alternating manner. Thus, the inkjet nozzles may print a print job onto the image receiving surface and spit into the spittoon from substantially the same position. Thus, the printhead(s), which may be in the form of a print bar, for example, may be controlled to implement a spitting routine, and/or other servicing routine, without having to be moved relative to the drum platen.

This gives rise to various advantages. For example, such an arrangement allows the inkjet nozzles to carry out spitting routines frequently, without overly affecting the throughput of the printer. It will be understood that by avoiding relative movement between the printheads and the platen, the frequency of time consuming alignment operations may be reduced.

In one embodiment, the spittoon is formed by a narrow recess, filled with ink absorbing foam, located in the circumferential surface of the drum. In such an embodiment, as the drum revolves, the recess may periodically pass adjacent the inkjet nozzles allowing the nozzles to spit. Whilst the recess is not adjacent the nozzles, the nozzles may print on an image receiving surface of the drum. In this manner, the spitting process may be implemented whilst the drum continues to rotate at the normal rotational velocity used for printing. Furthermore, since no complex movement is required between the printhead(s) and the drum, embodiments of the invention may benefit from having a relatively simple, reliable and inexpensive chassis structure supporting the drum and printhead(s). The relative positions of the axis of rotation of the drum relative to the printhead(s) may be fixed. Furthermore, such a chassis structure may facilitate the maintenance of an accurate pen-to-paper spacing, which in turn may help to ensure high print quality. Additionally, the space taken up by a printers of embodiments of the present invention may be small compared to systems in which printhead(s) must be moved, for example lifted or translated, relative to the drum in order to allow servicing.

According to another aspect of the invention, there is provided an inkjet printing device comprising a drum platen arranged to rotate about a rotational axis and a printhead located at a substantially fixed distance from the rotational axis, the circumferential surface of the platen having a recess adapted to allow a wiper assembly to pass between the platen and the printhead to wipe the printhead substantially without altering the distance between the printhead and the rotational axis of the platen. Advantageously, the present aspect of the invention also gives rise to the advantage of allowing a printhead, such as a print bar used to print on a drum platen, to be serviced without having to be moved relative to the drum platen.

According to another aspect of the invention, there is provided a drum platen for use in inkjet printing device, the platen being arranged to rotate about a rotational axis and having a circumferential surface disposed about the rotational axis, the circumferential surface having first and second portions the first portion adapted to support print media during a printing operation, the second portion comprising a printhead servicing recess, adapted to accept an inkjet servicing device. In one embodiment, the inkjet servicing device may be permanently or semi-permanently located in the recess; for example a spittoon. Alternatively, in another embodiment, the inkjet servicing device may from time to time pass into or through the recess. Such a servicing device may be a wiping material, such as Tex Wipe, or a wiping device such as a printhead wiping element made from conventional elastomeric material.

The present invention extends to the corresponding methods of operating a printer. In another aspect, the present invention also extends to computer programs, arranged to implement the methods of the present invention.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which:

FIG. 1*a* shows a schematic perspective view of a drum platen employed in a first embodiment of the invention;

FIG. 1*b* illustrates an enlarged schematic cross-sectional view of the drum shown in FIG. 1*a*, illustrating the recessed surface area of the drum;

FIG. 1*c* shows a schematic perspective view of the foam insert shown in FIGS. 1*a* and 1*b* when removed from the drum;

DETAILED DESCRIPTION OF THE PREFERRED EMBODIMENTS

Figure 2A:
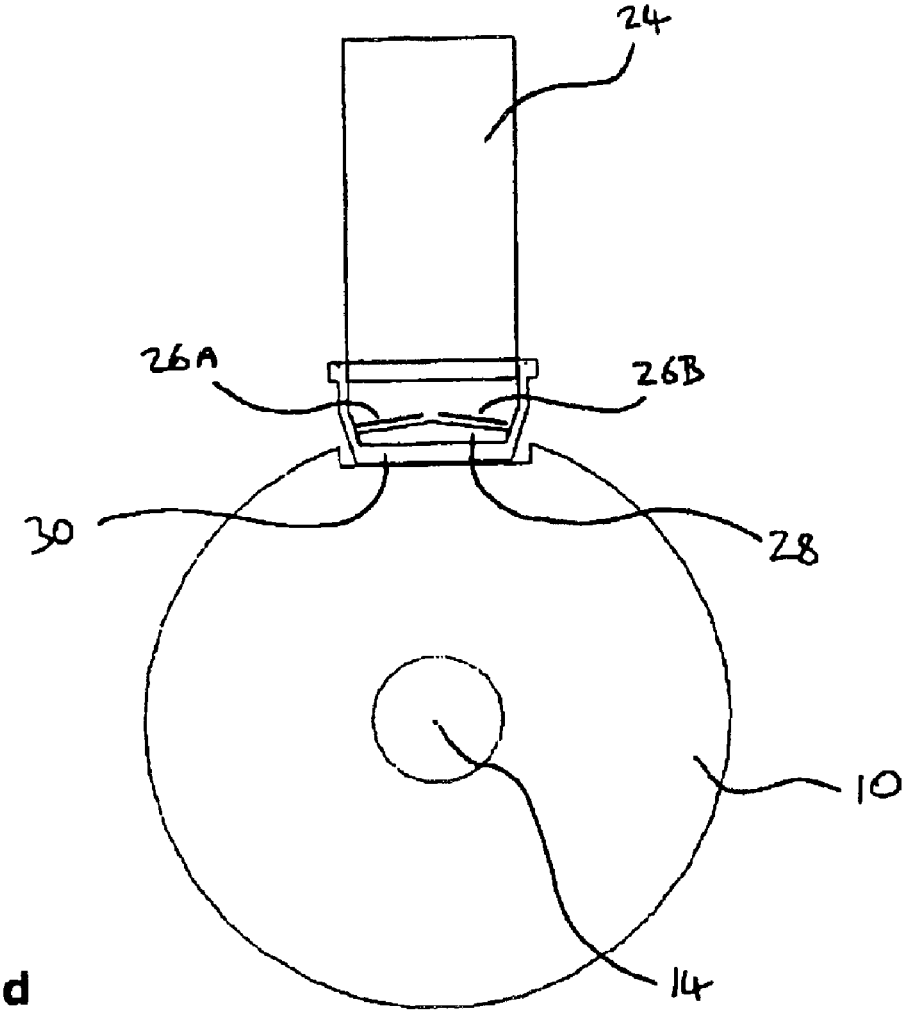
FIG. 2*a* shows a schematic end elevation of the drum of FIG. 1*a*, with the print bar and wiping assembly of the first embodiment in place, with the wiping assembly in a storage position.

There will now be described examples of the best mode contemplated by the inventors for carrying out the invention.

First embodiment

Referring to the figures, an embodiment of the present invention will now be described. FIG. 1*a* illustrates a perspective view of a drum platen 10 according to the present embodiment. The drum 10 has a circumferential surface 12, arranged to support print media so that it may be conveyed past an array of inkjet nozzles, illustrated in FIG. 2. The drum has a central shaft or axis 14 about which it is arranged to be driven in the direction of the arrow 16, using a conventional drive mechanism. The drum has a width "w" and its circumferential surface 12 is disposed about the central axis 14 at a radial distance "r". The drum may be supported in a conventional printer chassis (not shown).

As can be seen from FIG. 1*a*, the circumferential surface 12 of the drum 10 is recessed over an area 18. In the present embodiment, the recessed area 18 is rectangular with its length lying parallel with the drum's central axis 14 and extending across the entire width "w" of the circumferential surface 12 of the drum 10. The recessed area 18 has a width of "x".

FIG. 1*b* illustrates an enlarged cross-sectional view of the drum 10 along lines "A—A", illustrating the recessed area 18. As can be seen from the figure, the recess has a base portion 18*a* and two sidewalls 18*b* and 18*c* connecting the base portion 18*a* to the media supporting surface 12 of the drum. The base portion 18*a* of the recessed area 18 is planar and is, arranged perpendicularly to the radius "$r_1$" of the drum that passes through the centre of the width "x" of the base portion 18*a*.

An insert of ink absorbing foam 20 is located at the base of the recessed area 18. The foam insert is sized so that it covers the base of the recessed area 18 (i.e. it has a length and a width of approximately "w" and "x", respectively. The thickness "t" of the foam insert 20 is approximately constant across its area.

In the present embodiment, the depth of the recess and the thickness of the foam insert 20 are selected such that in operation, all points on the outer surface 20*a* of the foam insert 20 lie at a radial distance from the centre of the drum "c" that is less than the distance "r". In the present embodiment, the distance "$d_1$" (the distance along the radius "$r_1$" between the point where radius "$r_1$" intersects the outer surface of the foam insert 20 and where "$r_1$" is equal to "r") is sufficient to allow the wiping the print bar to be wiped as is described below.

The foam insert 20 in the present embodiment is arranged to be replaceable by an operator and may be secured in place in any suitable conventional manner; such as with mechanical clips or protrusions. In FIG. 1*c*, the foam insert 20 is illustrated removed from the drum. It will be understood that in other embodiments, a spittoon assembly may instead by replaced. Such an assembly may include a foam insert located in a plastic holder, or spittoon body. In this manner, the used foam may be replaced more easily, with less risk of ink spillage.

As can be seen from FIG. 1*a*, the end walls 22*a* and 22*b* of the drum 10 have been cut away or recessed in the region of the recessed area 18. The end walls 22*a* and 22*b* have been cut away to lie approximately flush with the outer surface 20*a* of the foam insert 20, when the foam insert 20 is in position.

The design of the drum 10 may in certain respects conform to the design of conventional drum platens. For example it may be manufactured of conventional material and in a conventional manner. It may include one or more systems arranged to assist in loading or unloading sheets. For example, a conventional media edge clamping system may be incorporated in the drum, to secure the leading edge of the media sheet during loading and transport of the media. The drum may also employ a system such as a vacuum hold down system or an electrostatic hold down system in order to help secure media sheets onto the media supporting surface of the drum. Such aspects of drum platens are well understood in the art and so will not be described further here.

Figure 2D:
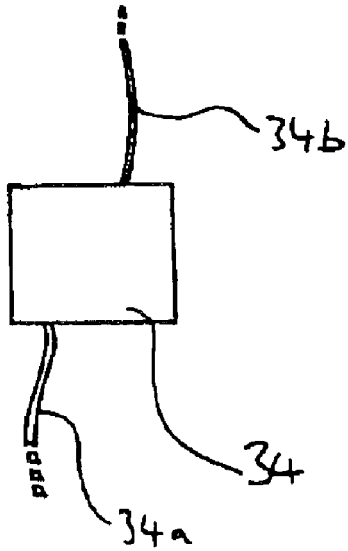
FIG. 2*d* illustrates a print controller which is associated with controlling the printing of the arrangements illustrated in preceeding figures.
Figure 2B:
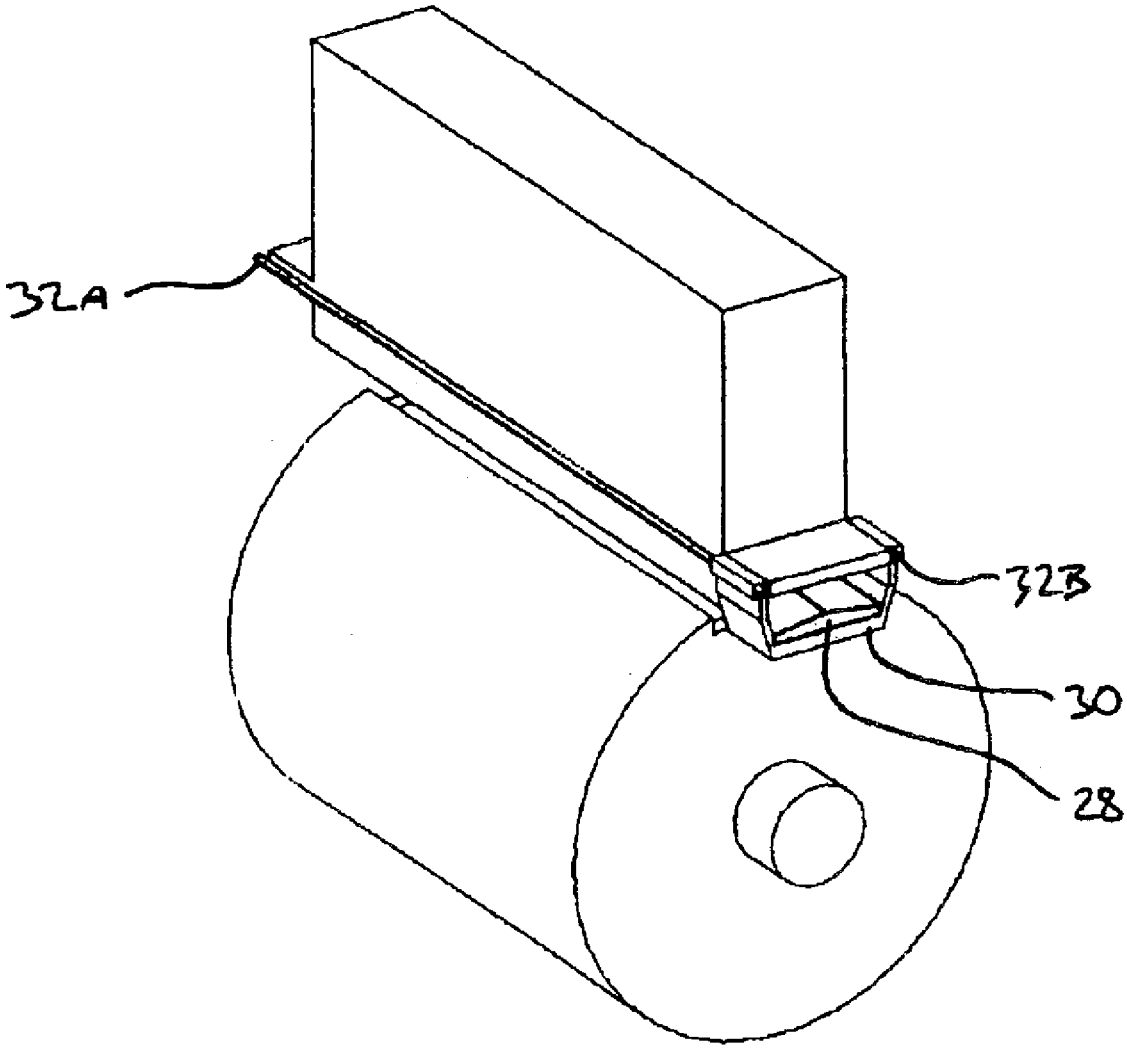
FIG. 2*b* illustrates a schematic perspective view of the drum, print bar and wiping assembly illustrated in FIG. 2*a*, with the wiping assembly in a storage position.
Figure 2C:
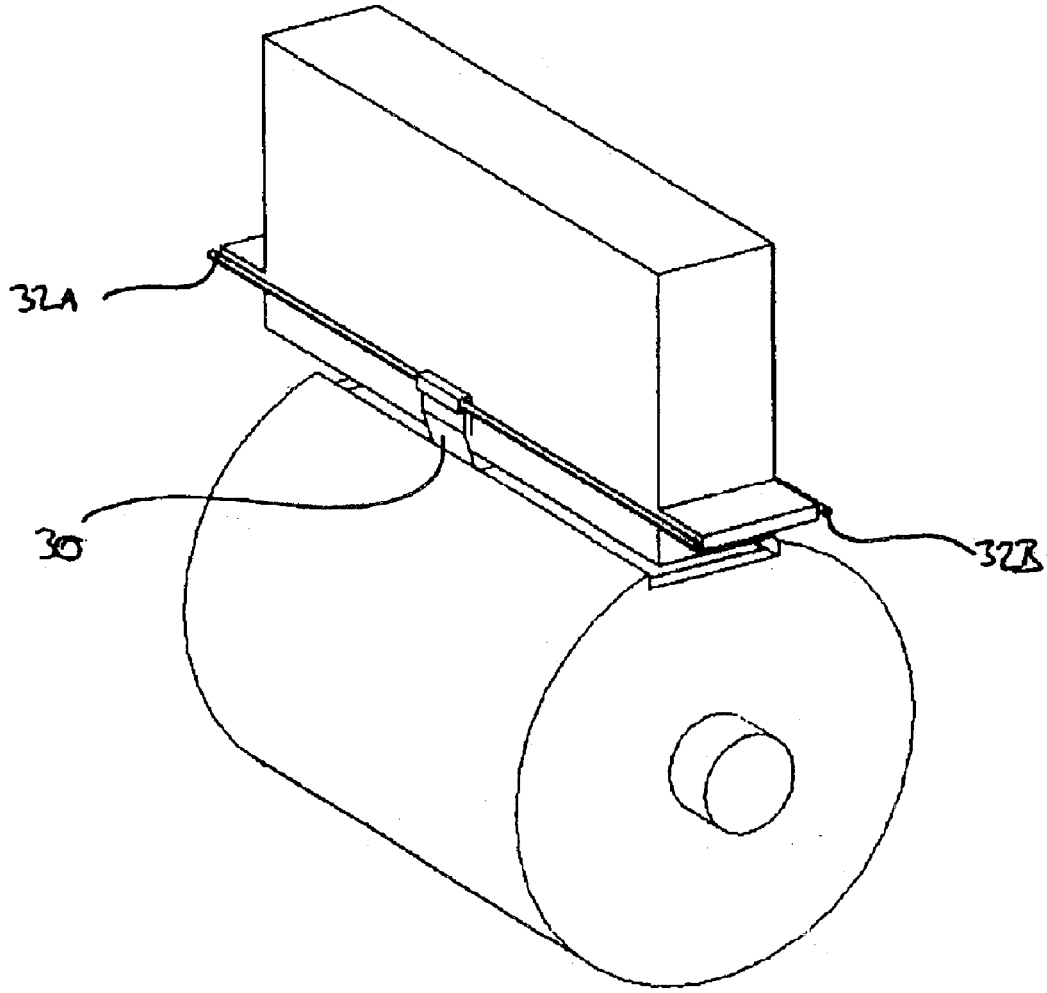
FIG. 2*c* illustrates a perspective view of the drum, print bar and wiping assembly illustrated in FIG. 2*a*, with the wiping assembly in an operational position.

In the present embodiment, a single print bar 24 is employed as is illustrated in FIGS. 2*a*, 2*b* and 2*c*. FIG. 2*a* shows a schematic end elevation of the drum of FIG. 1*a*, with the print bar and wiping assembly of the first embodiment in place. In this embodiment, the print bar 24 is made up of conventional thermal inkjet printheads, although other types of printheads may be used, such as piezoelectric printheads. The structure and operation of such printheads, and indeed inkjet print bars made up from such printheads, will be well understood by the skilled reader and so will not be described here further. However, examples of print bars suitable for use in the present embodiment are disclosed in: U.S. Pat. No. 6,428,145 B1, entitled "Wide-array inkjet printhead assembly with internal electrical routing system"; U.S. Pat. No. 5,719,602 A1, entitled "Controlling PWA inkjet nozzle timing as a function of media speed"; and, U.S. Pat. No. 5,734,394 A1, entitled "Kinematically fixing flex circuit to PWA print bar". Each of these references is in the name of Hewlett-Packard Co. and is hereby incorporated by reference in its entirety.

In the present embodiment, the print bar 24 is made up of two parallel rows of printheads, each row being aligned with the central axis 14 of the drum. In this manner, print media supported on the drum 10 is transported under the first row of printheads and subsequently under the second rows of printheads. Due to their different positions about the circumference of the drum 10, the nozzle plates of the first row of printheads are arranged at a different angle to the nozzle plates of the second row of printheads. The relative orientations of the nozzles plates of the two rows of printheads are illustrated in FIG. 2*a*, by the lines 26*a* and 26*b*, respectively.

In the present embodiment, each of the nozzles in the print bar 24 is arranged to print in black ink only. However, as is described below, printers according to other embodiments may be arranged to print using one or more coloured inks.

The print bar 24 is arranged to be held in a fixed position relative to the chassis (not shown) of the printer. In the present embodiment, the drum 10 also has its axis 14 mounted stationary relative to the print bar. This ensures that the distance between each of the nozzle plates of the printheads making up the print bar 24 and the media supporting surface 12 of the drum 10 is maintained substantially constant. In this manner, it is possible to ensure that this distance is maintained accurately. In turn, this helps to ensure that print quality is not adversely affected by errors or fluctuations in the "pen-to-paper spacing" of the printer. Furthermore, since it is not required to design the chassis of the printer of the present embodiment to allow complex movement between the print bar and the drum, a relatively simple and inexpensive printer chassis may be used.

Referring now to FIG. 2*b*, a schematic perspective view of the drum, print bar and wiping assembly is shown. As can be seen from the figure, the print bar has two slider rods or rails 32*a* and 32*b*. The rails 32*a* and 32*b* are each arranged to run along the length of, and on opposing side of, the print bar. The rails 32*a* and 32*b* run parallel to lower surface of the print bar, and so run parallel to the array of nozzle plates which it contains. A generally "U" shaped carriage 30, is suspended or connected to the two rails 32*a* and 32*b* by a corresponding pair of arms. The arms of the carriage are connected by a carriage base portion located on the nozzle plate side of the print bar. The carriage is slidably connected to the rails 32*a* and 32*b* and is free to be driven by a motor (not shown) from one end of the pair of rails 32*a* and 32*b* to the other, in order to traverse the length of the print bar. The carriage base portion is arranged to support a wiper element 28 in a conventional manner. In the present embodiment, the wiper element is a conventional elastomeric wiper, although in other embodiments alternative wiper technologies may be used; for example ink absorbent materials. The elastomeric wiper element 28 is shaped and positioned so as to wipe the surface of all of the nozzle plates of the printheads of the print bar as the carriage traverses the length of the print bar. The elastomeric wiper may be manufactured out of any suitable material. Such materials are well understood in the art and so will not be discussed further herein.

It will be understood that alternative arrangements of locating and supporting the wiper element are possible. However the arrangement of the present embodiment is comparatively simple yet at the same time allows the position of the wiper element relative to the printheads to be controlled to a sufficient degree of accuracy to allow effective wiping. 391 It will be noted from FIG. 2*b* that the rails 32*a* and 32*b* are somewhat longer than the print bar and extend a relatively short distance to either side of the print bar. Thus, the carriage 30 and the elastomeric wiper may be supported at either end of the pair of rails 32*a* and 32*b* in a storage position in which they are not positioned between the nozzle plates of the printheads of the print bar and the drum. In this manner, the drum may rotate and the ink ejection nozzles may print ink without being obstructed by the carriage 30 and the wiper element 28. The carriage 30 and the wiper element 28 are illustrated in a storage position at one end of the pair of rails in FIG. 2*b*. Thus, in the present embodiment, the wiper is located beneath the print bar and when not in use, is static in relation to the print bar.

In the present embodiment, the space between the print bar and the surface of the drum 10 is not sufficient to allow the carriage 30 to move from a storage position unless the recessed portion 18 of the drum surface is immediately adjacent the print bar. The drum is illustrated in this orientation in FIGS. 2*a*, 2*b* and 2*c*. When the drum is in this position, however, the carriage 30 may move along the pair of rails 32*a* and 32*b* in order to traverse the length of the print bar, as is illustrated in FIG. 2*c*. In so doing, the elastomeric wiper element 28 is brought into contact with, and wipes the surface of each of the of the nozzle plates of the printheads of the print bar.

In other words, in the present embodiment, the distance between the nozzle plate of the pens making up the print bar and the surface of the drum that is arranged to receive spitted ink is greater than the distance between the nozzle plate of the pens and the remainder of the drum surface that supports the print medium. This greater distance allows the wiping assembly to traverse the length of the print bar, between the drum and the nozzle plates of the printheads. It will be appreciated, however, that it may be desired in some embodiments to keep the "spitting distance", i.e. the distance between the printhead and the ink receiving surface of the spittoon, relatively small. By doing so, the degree of airborne aerosol droplets of ink, which are generated by the process of spitting, may be reduced.

Referring to FIG. 2*d*, the printer according to the present embodiment also has a print controller 34. This may be a conventional general purpose microprocessor or an ASIC, as is schematically illustrated in the figure. As is conventional in many printing systems, the controller 34 may receive instructions from a host device (not shown) via a conventional communications link 34*a*, which is typically a computer, such as a personal computer or a computer aided drafting (CAD) computer system. The printer controller 34 may also operate in response to user inputs provided through a user input device, such as a keypad or status display portion (not shown). Such user input devices are generally located on the exterior of the casing (not shown) of the printer. The printer controller 34 has associated memory (not shown), which may include ROM, RAM and a non-volafile data storage module, such as a high capacity hard disk drive. Image data, downloaded from a host device, may be stored in the RAM prior to being printed. The printer operating instructions, may be stored in ROM which the controller 34 may access in order to carry out the functions of the printer.

In operation, the controller 34 outputs control instructions to control the operation of the printer via a conventional communications link 34*b*. In this manner, the controller causes the drum 10 to rotate and sheets of print media to be loaded onto the drum in a conventional manner by controlling the necessary actuators. The controller also causes the ink ejection nozzles to eject ink drops onto the print media to print a print job in a normal manner as the media passes beneath the print bar.

From time to time, the controller may determine that selected inkjet nozzles should implement a spitting operation. This determination may be made in any conventional manner. Once per revolution of the drum, the recessed portion 18 of the drum passes adjacent to the print bar. When it does so, the controller may control selected nozzles to spit ink such that the spitted ink is ejected onto the foam insert 20 located at the base of the recessed area 18 of the drum. In the present embodiment, the relative dimensions of the drum and the media sheets, together with the operation of the controller 34 are arranged such that the media sheets are not loaded onto the drum so as to overlie the recessed portion 18 of the drum. As the recessed area 18 of the drum passes beyond the print bar and print media is once again brought under the print bar, the controller may continue to control the ink ejection nozzles of the print bar to print the print job. In this way, a spitting routine may be implemented without significantly interrupting the printing of the print job, or having to move the print bar relative to the platen. Furthermore, this may be carried out without stopping or indeed altering the rotational velocity of the drum.

The foam of the foam insert and the ink used are in the present embodiment selected such that foam insert 20 readily absorbs the ink spitted onto it. In this manner, the risk of accidental leakage of spitted ink is greatly reduced. In the present embodiment, conventional dye based ink is used. In other embodiments, pigmented ink may be used.

Although in this embodiment, spitting operations have been described as occurring during the printing of a print job, the skilled reader will appreciate that the controller may also implement one or more spitting routines before starting or after finishing a print job. In either case, however, it will be understood that controller may position the drum such that the foam insert 20 is correctly positioned to receive spitted ink and then leave the drum stationary throughout the spitting operation. It may be convenient to do this where a prolonged spitting operation is required. For example on starting up the printer after a long period of inactivity, or where an aggressive servicing routine is deemed to be required.

Over a period of time the number of spitting operations carried out will cause the quantity of ink held in the foam insert to rise to the point where the foam insert should be replaced in order to avoid ink spillage. The quantity of ink held in the foam insert may be monitored by the controller. This may be done using conventional drop counting techniques, for example. Once it is estimated that the foam insert has absorbed a predetermined quantity of ink, the controller may output a service required massage via the user interface of the printer. This may then be carried out by an operator.

From time to time, the controller 34 will determine that the nozzles of the print bar should be wiped. Again this determination may be made in any conventional manner. As with spitting operations this may be carried out during the printing of a print job or between printing print jobs. However, in order to implement a wiping operation in the present embodiment, the controller controls the drum to stop rotating at the angular position in which the recessed area 18 of the drum lies adjacent the print bar. Once the drum is stationary in this angular position, the controller actuates the carriage drive motor to drive the carriage 30 from one end of the pair of rails 32*a* and 32*b* to the other. As has been described above, in so doing, the elastomeric wiper element 28 wipes and cleans the surfaces of each of the of the nozzle plates of the printheads of the print bar. The carriage may be driven across the print bar once, twice or any other required number of times during a wiping operation. In the present embodiment, for speed of operation, the wiping element may be driven across the print bar a single time and is thus arranged to stop at either end of the print bar at the end of a wiping stroke.

The skilled reader will understand that as is conventional in the art, the wiper element 28 may be loaded with an ink solvent such as PEG in order to facilitate the cleaning process at one or both storage positions, prior to a wiping process being undertaken. Similarly, one or more conventional wiper cleaner devices may be used to clean the wiper element periodically. Such devices may also be located at one or both storage positions.

It will also be understood that the wiping and spitting operations according to the present embodiment may be carried out at substantially the same time or at substantially different times.

Further Embodiments

It will be apparent to one skilled in the art that certain well known methods and structures have not been described in detail so as not to unnecessarily obscure the present invention. For example, components such as a printer casing, a user interface, ink supply modules and the like, together with certain printing methods such as data processing, including steps such as halftoning, colour calibration and the like, were not described in detail in the above description. However, such components and methods are well understood in the art of inkjet printing. In such cases a wide variety of known components and methods are suitable for use with embodiments of the present invention.

Additionally, numerous specific details are set forth in the above embodiment, in order to provide a thorough understanding of the present invention. It will, though, be apparent that the present invention may be practiced without limitation to these specific details. For example, although the above-described embodiment is described with reference to a printer, the skilled reader will appreciate that the present invention may equally be used as a printing engine for use in other hardcopy devices, such as copiers.

In the first embodiment described above, a recessed area in the drum surface provided both an area for collecting spitted ink and a space which allowed a wiper assembly to pass between the drum and the print bar. However, the skilled reader will appreciate that in other embodiments of the invention these aspects of the invention may be employed separately.

In one example of such an embodiment, the drum may have a spittoon located in its surface. This may take the form of a foam insert, located in a recess in the drum surface. This may be the same as, or similar to, the arrangement in the first embodiment of the foam insert 20 located in the recess 18. However, in this embodiment, a wiper assembly corresponding to the wiper element 28 in the embodiment described above is absent. The arrangement of this embodiment retains the advantages of being able to carry out spitting during, or in between print jobs. This embodiment may be advantageous in hardcopy apparatus in which it is envisaged that wiping may satisfactorily be implemented in another manner; for example, moving the print bar relative to the drum axis to allow a wiping element to be brought into contact with the nozzle plates of print bar. One advantage of such an embodiment is that the "spitting distance" may be reduced. That is to say that the distance that the spitted ink drops travel, between leaving the printhead and contacting the surface of foam insert or other spittoon ink receiving surface, may be reduced. In this manner, the degree of airborne aerosol droplets of ink, which are generated by the process of spitting, may be reduced. It will be appreciated if the wiper does not pass between the drum surface and the print bar, then the surface of the foam insert which receives the spitted ink need not be recessed, or recessed to the same extent, relative to that part of the drum surface which supports the print media; i.e. it may be at approximately the same radial distance from the central axis of the drum as that part of the drum surface which supports the print media.

In a further example of such an embodiment, the print bar may have a wiper assembly which is similar to, or the same as, carriage 30 and the wiper element 28 in the first embodiment described above. However, in this embodiment, the drum does not have a spittoon located in its surface. The arrangement of this embodiment may be advantageous if frequent wiping but not spitting is required, for example. In a further such embodiment, the carriage 30, which supports the wiping element(s), may additionally or instead support a spittoon. Such a spittoon may be comparatively small. In this way, different nozzles of a printhead may spit into the spittoon as the spittoon travels, together with the carriage 30 along the length of the print bar.

Although in the first embodiment, the hardcopy apparatus is described as having a single print bar, this too may be varied. In other embodiments, two, three, four or more print bars could be arranged to print on media supported on the same drum. In such embodiments, each print bar may be arranged to print a different colour of ink, or indeed a fixer substance. For example, in one such embodiment, five print bars are employed. One of the five print bars is arranged to print a conventional fixer liquid, whilst each of the remaining four print bars is arranged to print a different one of the coloured inks: cyan; magenta; yellow; and, black. In this exemplary embodiment, each print bar has its own dedicated wiping apparatus such as the carriage 30 and the wiper element 28 described in the first embodiment above. In this exemplary embodiment, the each of the print bars may have their own dedicated spittoon, or one or more, or indeed all of the print bars may share a spittoon.

Although in the first embodiment, the wiping assembly was described as having a single wiping element, the skilled reader will appreciate that this may in practice be varied. For example, the carriage 30 may support two or more elastomeric elements of fins that are arranged to wipe the nozzle plates of given print bars in series; i.e. one element proceeding another. Altematively, different wiping elements may be used to wipe different nozzles of the print bar. For example, one wiping element may wipe nozzles in the location 26*a*, illustrated in FIG. 2*a* and another wiping element may wipe nozzles in the location 26*b*, also illustrated in FIG. 2*a*. In this manner, the nozzles in the two locations 26*a* and 26*b* may print different coloured ink with a reduced risk of cross contamination between the ink colours.

In a further embodiment, more than one spittoon, or spitted ink receiving area, may be located in the drum surface. In this embodiment, each spittoon may be the same as, or similar to the recessed area 18 and ink absorbing foam insert 20 described in the first embodiment. One advantage of such an arrangement is the different inks or fixer substances, may be spitted into different spittoons to be stored separately. This may be useful where two different spitted materials, for example an ink and a fixer, would react together in a manner which would damage the ability of the foam to properly absorb further spitted ink or fixer. However, in order to avoid overly reducing the usable media supporting area of the drum, it may be beneficial to make the multiple spittoons of this sort of reduced surface area. In this manner any adverse affect on printer throughput may be reduced. This may be achieved by making the spittoons deeper to preserve their storage capacity. Alternatively, smaller capacity spittoons may be used, which may require emptying more frequently.

In a further embodiment of the invention, pigmented ink may be spitted directly onto the bottom of a spittoon; i.e. it may be chosen not to use a foam insert in such an embodiment. In such an embodiment, part of the body of the carriage 30 may be used to scrape out spitted ink from the spittoon. This ink may be deposited into a further spittoon located adjacent to the one or both ends of the drum.

Although each of the embodiments described above has a static print bar, the skilled reader will appreciate that this need not be the case. For example, where a scanning printhead is used to print a drum platen, a spittoon located in the surface of a platen and/or a wiping assembly as described in embodiments above may be beneficially employed.

In other embodiments, the hardcopy device may incorporate a conventional capping system that seals and protects the printhead nozzles from contaminants and drying out during non-printing periods.

The skilled reader will appreciate that the various further embodiments described herein may be used in combination with one or more of the remaining further embodiments.

What is claimed is:

1. An inkjet printing device comprising a drum platen, the platen having a spittoon disposed in the surface of the drum, the spittoon comprising:

a recess which extends across the platen and which has a width, a length and a depth, and an ink absorbing member seated stationarily on a bottom of the recess, the ink absorbing member having a width and a length essentially equal to the width and length of the recess, and a thickness less than the depth of the recess.

2. A device according to claim 1, wherein the circumferential surface of the platen has a print media supporting area having a width parallel to the axis of rotation of the platen, the length of the recess being substantially equal to a width of the print media supporting area.

3. A device according to claim 2, wherein the ink absorbing member comprises a foam insert adapted receive and absorb ink spitted onto it.

4. A device according to claim 3, wherein the ink receiving surface of the foam insert is arranged to lie approximately flush with the adjacent print media supporting area.

5. A device according to claim 3, wherein the ink receiving surface of the foam insert is arranged to be recessed relative to the adjacent print media supporting area.

6. A device according to claim 2, further comprising one or more ink ejection elements being controllable to print ink drops forming part of a printjob whilst the print media supporting area of the platen lies adjacent one or more ink ejection elements and being controllable to spit into the spittoon whilst the spittoon lies adjacent one or more ink ejection elements.

7. A device according to claim 6, wherein the one or more ink ejection elements are arranged to remain at a substantially fixed distance from the axis of rotation of the platen.

8. A device according to claim 7, wherein the one or more ink ejection elements form a page wide array of ink ejection elements substantially spanning the print media supporting area.

9. An inkjet printing device comprising a drum platen arranged to rotate about a rotational axis and a printhead located at a substantially fixed distance from the rotational axis, the circumferential surface of the platen having a recess adapted to seat a stationary ink absorbing member therein and to allow a wiper assembly to pass between the platen and the printhead to wipe the printhead substantially without altering the distance between the printhead and the rotational axis of the platen.

10. A device according to claim 9, wherein the printhead forms a part of a print bar, spanning at least a portion of the printable width of the platen.

11. A device according to claim 10, wherein the print bar is arranged to span substantially the entire printable width of the platen.

12. A device according to claim 10 or claim 11, wherein the recess has dimensions allowing the wiper assembly to travel substantially the entire length of the print bar.

13. A device according to claim 12, wherein the print bar comprises a guide adapted to support the wiper assembly and to enable the wiper assembly to travel substantially the entire length of the print bar.

14. A device according to claim 13, wherein the guide comprises at least one rail, or groove.

15. A device according to claim 9, further comprising a wiper assembly storage position, in which the wiper assembly may be stored whilst the platen is rotating such that the wiper assembly does not interfere with the rotation of the platen.

16. A device according to claim 9, wherein the recess forms a spittoon adapted to receive ink spitted by the printhead during a spitting routine.

17. A drum platen for use in inkjet printing device, the platen being arranged to rotate about a rotational axis and having a circumferential surface disposed about the rotational axis, the circumferential surface having first and second portions the first portion adapted to support print media during a printing operation, the second portion comprising a printhead servicing recess, adapted to seat a stationary ink absorbing member on the bottom thereof.

18. A method of operating an inkjet printer having a rotatable drum platen and a spittoon disposed in the circumferential surface of the platen, comprising the steps of:

printing image data with a plurality of ink ejection elements onto an image receiving surface on the circumferential surface as the platen rotates relative to the ink ejection elements;

controlling one or more of the plurality of ink ejection elements to spit into the spittoon when the platen rotates to an angular position such that the spittoon is adjacent the one or more ink ejection elements; and absorbing ink which is spit into the spittoon using a stationary ink absorbing member seated on the bottom of a recess forming the spittoon.

19. A method according to claim 18, wherein the one or more ink ejection elements are controlled to spit whilst the drum is rotating.

20. A method according to claim 19, further comprising the step of stopping the rotation of the platen prior to implementing a spitting operation.

21. A computer program comprising program code for performing the method steps of claim 18, when the computer program is run on a processing device associated with a suitable printer device.

22. A method of operating an inkjet printer having a rotatable drum platen having a circumferential surface comprising a localised recess, the printer further comprising a print bar arranged to print image data onto an image receiving surface on the circumferential surface as the platen rotates relative to the ink ejection elements, comprising the steps of:

stopping the rotation of the platen such that the recess is adjacent a print bar;

absorbing ink using a stationary ink absorbing member disposed on a bottom of the localized recess; and driving a wiping element connected to the print bar along said recess, between the platen and the printhead, to wipe the printhead substantially without altering the distance between the printhead and the rotational axis of the platen.

23. A method according to claim 22, wherein the wiping assembly is driven along substantially the entire length of the print bar.

24. A computer program comprising program code for performing the method steps of claim 22, when the computer program is run on a processing device associated with a suitable printer device.

* * * * *